United States Patent [19]

Holstein et al.

[11] 3,986,759

[45] Oct. 19, 1976

[54] VENDOR WITH MANEUVERING FEATURE

[75] Inventors: Alvin W. Holstein, Brentwood; John E. Stanhope, St. Louis, both of Mo.

[73] Assignee: UMC Industries, Inc., New York, N.Y.

[22] Filed: Jan. 14, 1976

[21] Appl. No.: 648,928

[52] U.S. Cl. ..... 312/257 A; 312/293; 312/250

[51] Int. Cl.[2] ..... A47B 43/00

[58] Field of Search ..... 312/257 A, 294, 293, 312/250

[56] References Cited

UNITED STATES PATENTS

| | | | |
|---|---|---|---|
| 2,115,239 | 4/1938 | Strain | 312/293 |
| 2,912,294 | 11/1959 | Wells et al. | 312/257 A |
| 2,991,140 | 7/1961 | Anderson et al. | 312/250 |
| 3,222,117 | 12/1965 | Schwartz | 312/250 |
| 3,628,842 | 12/1971 | Wright | 312/293 |
| 3,779,623 | 12/1973 | Motohashi | 312/257 A |

*Primary Examiner*—Casmir A. Nunberg
*Assistant Examiner*—Victor N. Sakran
*Attorney, Agent, or Firm*—Koenig, Senniger, Powers and Leavitt

[57] ABSTRACT

A vendor of the type comprising a cabinet having a bottom, top, sides, back and a front door, in which the bottom and top each comprises a main panel formed to provide a space between the front of the cabinet and the main panel and a filler panel removably attached to the main panel and filling the space between the front of the main panel and the front of the cabinet. The fillers are removable to open said spaces to enable the cabinet to be maneuvered, with the front door opened, through a doorway which is narrower than the overall width or depth of the cabinet but wider than the depth of the cabinet from the back of the cabinet to said spaces.

10 Claims, 13 Drawing Figures

VENDOR WITH MANEUVERING FEATURE

BACKGROUND OF THE INVENTION

This invention relates to vendors, and more particularly to vendors for vending so-called snack products including bags of potato chips, pretzels and the like.

The invention is especially concerned with a spiral vendor of the rear-to-front type, such as shown in U.S. Pat. Nos. 3,178,055, 3,269,595, 3,344,953, 3,591,045, 3,653,450 and 3,773,217, comprising a cabinet having a front door, shelves in the cabinet having their forward ends spaced rearward from the door to provide a drop space, helices on the shelves extending to rear-to-front direction with respect to the cabinet and adapted to receive items to be vended between their convolutions, the door having a window for viewing the forwardmost items, and means for rotating each helix to advance the items in the convolutions of the helix toward the forward end of the respective shelf and discharge the forwardmost items off the forward end of the shelf to drop down in said drop space.

Rear-to-front spiral vendors such as above-described have come into use for vending candy, gum and mints and so-called snack products, including bags of potato chips, pretzels and the like. A problem has been encountered in dispensing such bags in that in some instances the bags, instead of dropping, tip over and become bridged against the window of the vendor. Increasing the distance between the forward ends of the shelves and the window aids in reducing the occurrence of such bridging, and increasing this distance to a dimension greater than the height of the bags eliminates it without diminishing the capacity of the vendor. This increase in distance, however, introduces a new problem in that this increases the depth of the cabinet to the point where it is impossible to move the cabinet in (or out) through a doorway narrower than the overall width or depth of the cabinet. (In this regard, the width of the cabinet is generally greater than the depth). Consequently, the cabinet cannot be brought in (or out) through narrower doorways either in front-to-rear or side-to-side direction.

SUMMARY OF THE INVENTION

Among the several objects of this invention may be noted the provision of an improved vendor which, while capable of being manufactured in increased depth for greater vending capacity, is capable of being maneuvered through narrower doorways; the provision of such a vendor of the rear-to-front spiral type; and the provision of such a vendor involving low additional cost for provision of such maneuverability.

In general, the invention comprises a vendor cabinet having a bottom, top, sides, back and a front door in which the bottom and top each comprises a main panel formed to provide a space between the front of the cabinet and the panel, and a filler removably attached to the cabinet filling said space, the fillers being removable to open said spaces to enable the cabinet to be maneuvered, with the front door opened, through a doorway which is narrower than the overall width or depth of the cabinet, but wider than the depth of the cabinet from the back of the cabinet to said spaces. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
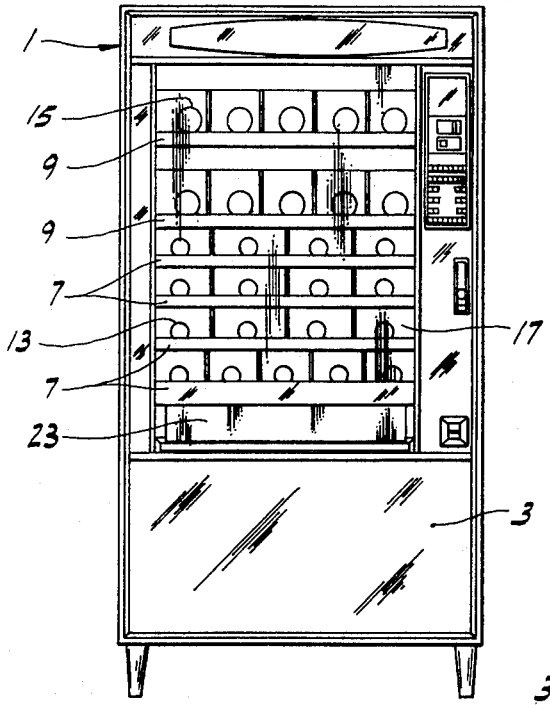
FIG. 1 is a front elevation of a vendor of this invention.
Figure 2:
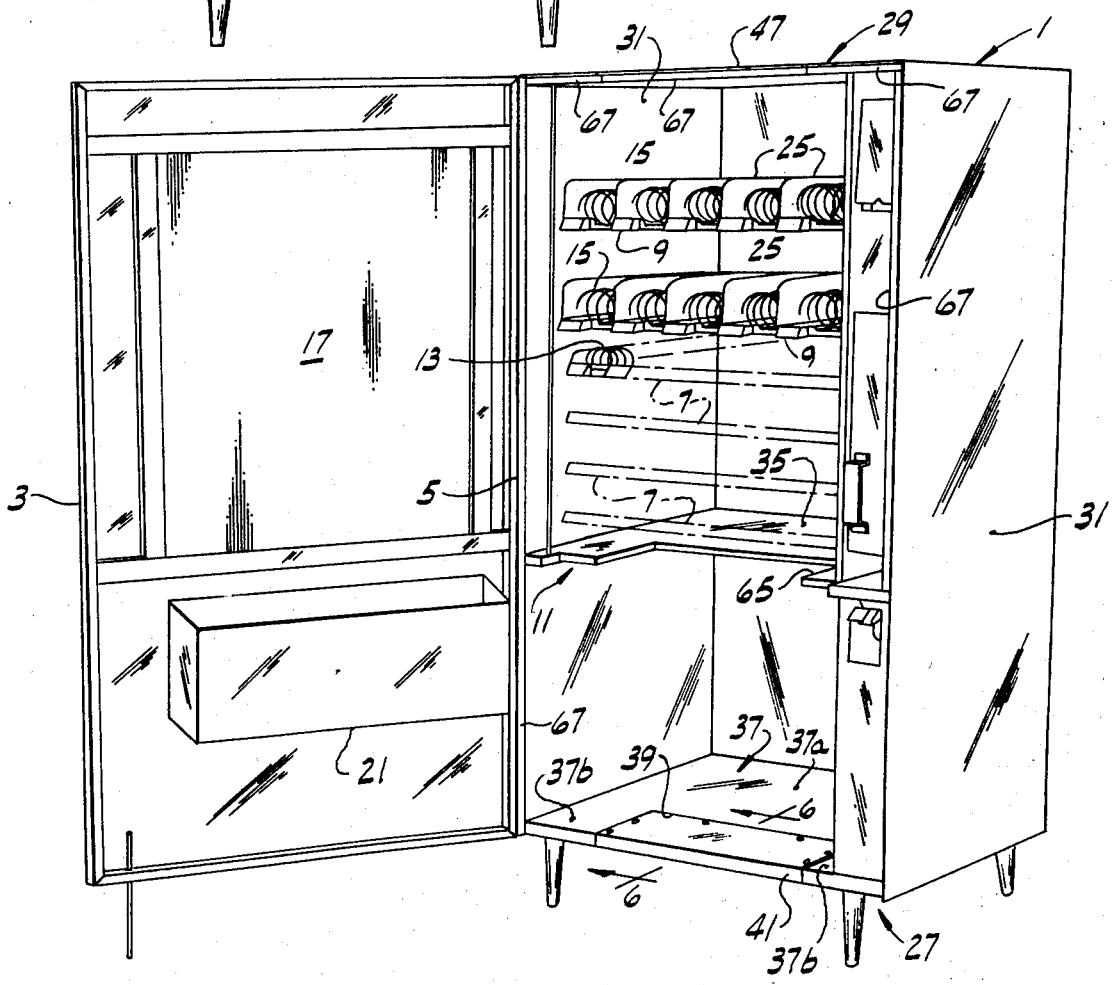
FIG. 2 is a perspective of the vendor with its front door open.
Figure 3:
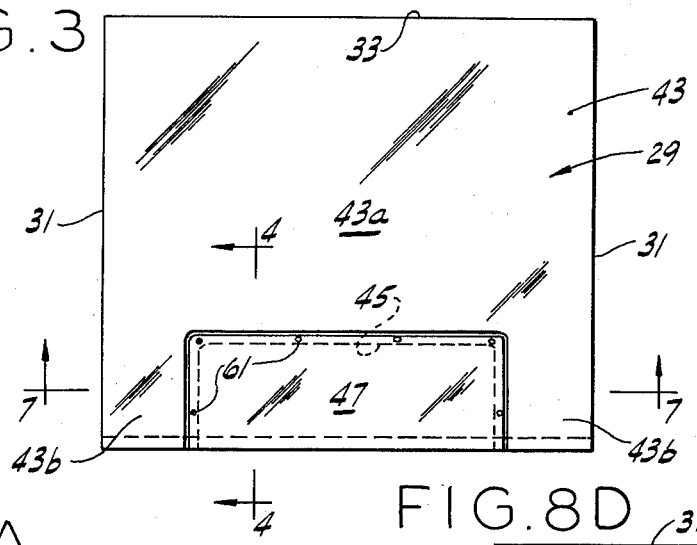
FIG. 3 is a top plan view of the vendor of FIG. 1 showing the top filler panel.

Referring to the drawings, a vendor incorporating the present invention is shown generally to comprise a cabinet 1 having a front door 3 hinged at the left as indicated at 5 in FIG. 2. Within the cabinet there are a plurality of dispensing units or shelves, one above another. As shown, there are six shelves, of which the four lower shelves, each designated 7, are for dispensing candy, gum and mints and the upper two shelves, each designated 9, are for dispensing snacks. Generally, the term "snack" refers to a bagged item such as chips (e.g., potato chips), pretzels and the like; "candy" refers to candy bars; and "mints" refers to roll-type packages of mints. Means is provided mounting each shelf for sliding movement in rear-to-front direction into and out of the cabinet. Each shelf, when slid into the cabinet, has an operative or vending position within the cabinet wherein, with the door 3 closed, the forward end of each shelf is spaced rearward from the door 3 to provide a drop space 11. Each shelf is slidable forward to a loading position extending forward from the cabinet when the door 3 is open, and may be removed by sliding it all the way out if so desired.

Each shelf has a plurality of helices thereon, each helix extending in rear-to-front direction with respect to the cabinet. Each helix on each of the shelves 7 is designated 13 and is adapted to receive items such as candy, gum or mints between its convolutions. Each helix on each of the shelves 9 is designated 15 and is adapted to receive items such as bags of chips between its convolutions. The door 5 has a window 17 for viewing the forwardmost items. Each helix is rotated to advance the items loaded between its convolutions toward the forward end of the respective shelf and discharge the forwardmost item off the forward end of the shelf to drop down in said drop space 11 to a delivery pan 21 from which it may be taken out by the customer by pushing in a delivery door 23 in the door 3 below the window 17. Each shelf also has guides 25 extending in rear-to-front direction at opposite sides of each helix defining a rear-to-front path of travel for the items loaded between the convolutions of the helix.

The cabinet 1 has a bottom 27, a top 29, left and right sides each designated 31, and a back 33. It is also shown as having a fixed horizontal partition 35 therein directly below the lowermost shelf. This partition divides the space in the cabinet into an upper and a lower compartment, the shelves being in the upper compartment. In accordance with this invention, the bottom 27 comprises a main bottom panel 37 secured to the sides and back of the cabinet formed to provide a space 39 between the front of the cabinet (i.e., the vertical plane of the front edges of sides 31 of the cabinet) and the edge of the main bottom panel 37 at the rear of space 39, and a filler 41 removably attached to the main bottom panel and filling the space 39. The top 29 comprises a main top panel 43 secured to the sides and back of the cabinet formed to provide a space 45 between the front of the cabinet and the edge of the main top panel 43 at the rear of space 45, and a filler 47 removably attached to the main top panel and filling the space 45.

While the entire front of each of the main bottom and top panels 37 and 43 could be recessed back from the front of the cabinet to provide the stated spaces 39 and 45, it is preferred that each of these panels have an intermediate portion 37*a*, 43*a* terminating short of the front of the cabinet and side portions 37*b*, 43*b* extending to the front of the cabinet (i.e., to the front edges of sides 31 of the cabinet), whereby each main panel 37 and 43 has a rectangular recess at the front providing the respective space 39, 45. The fillers 41 and 47 are constituted by rectangular panels shaped to fill or cover the respective spaces or recesses 39, 45.

Figures 4, 5, 6, 7:
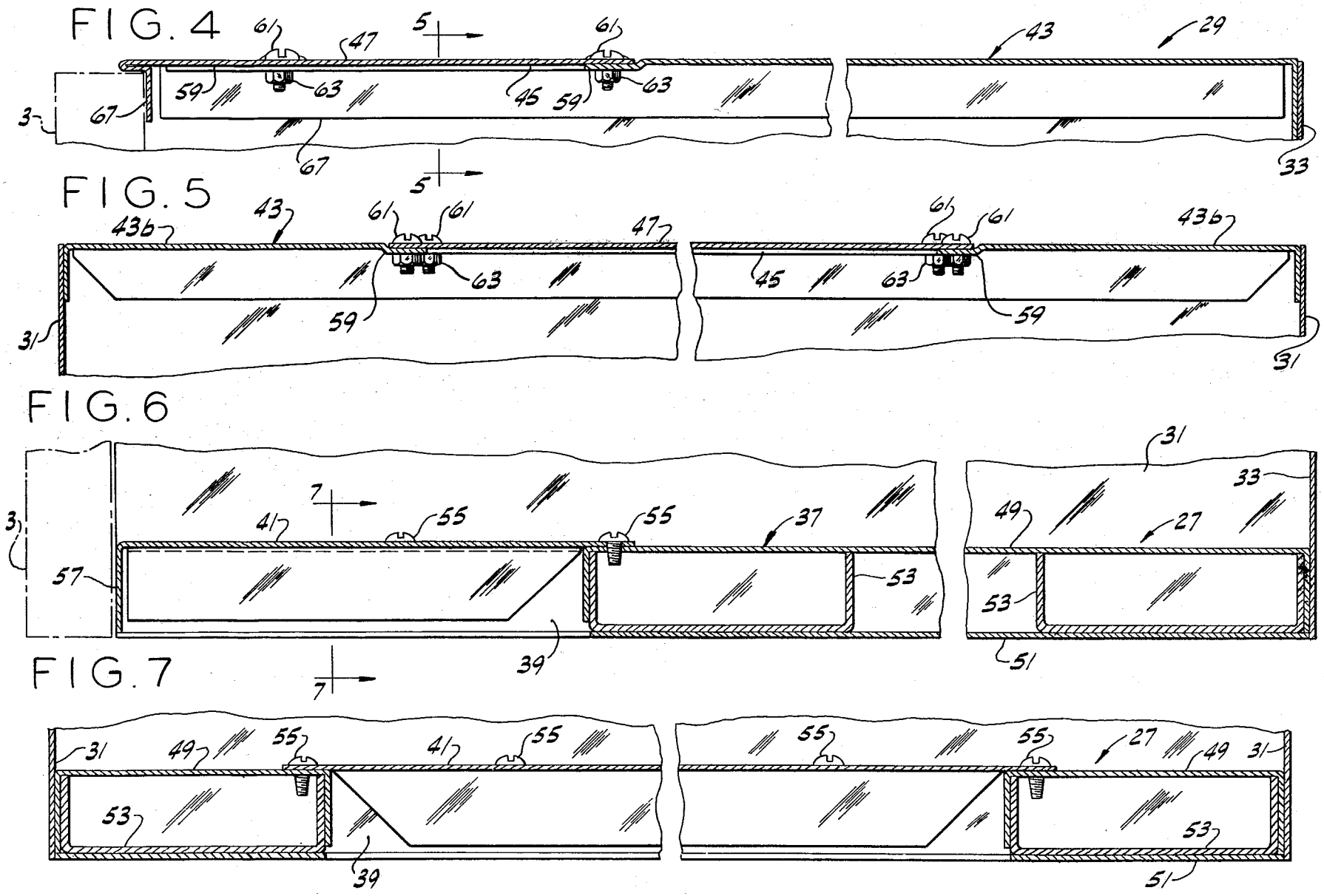
FIG. 4 is an enlarged vertical section taken on line 4—4 of FIG. 3.
FIG. 5 is a transverse vertical section on line 5—5 of FIG. 4.
FIG. 6 is an enlarged vertical section on line 6—6 of FIG. 2.
FIG. 7 is a transverse vertical section on line 7—7 of FIG. 6.

Referring to FIGS. 6 and 7, the main bottom panel 37 is shown as comprising a top plate 49 and a bottom plate 51 with channel members 53 therebetween. The bottom filler panel 41 is shown as having its rearward and side margins seated against the top plate 49 of the main bottom panel 37 at the sides and back of the recess 39, being removably attached to the bottom panel by means of self-tapping screws 55 extending through screw holes in the filler panel and the top plate 49 of the bottom panel. It is also shown as having a downwardly extending flange 57 at the front for engagement by the front door 3 when the latter is closed. Referring to FIGS. 4 and 5, the top filler panel 47 is shown as having its rearward and side margins seated on downwardly offset margins 59 of the main top panel 43 at the sides and back of the recess 45 in the main top panel, being removably attached thereto by means of bolts 61 welded to the top filler panel 47 extending down through bolt holes in the main top panel margins 59 and nuts 63 threaded on the lower ends of the bolts within the cabinet. The downward offset of the margins 59 is such as to mount the top filler panel 47 generally flush with the main top panel 43. The screws 55 are accessible only from the inside of the cabinet when the door 3 is opened for removal thereof to remove the bottom filler panel 41. Similarly, the nuts 63 on bolts 61 (which are permanently secured to the top filler panel 47) are accessible only from the inside of the cabinet when the door 3 is opened for removal thereof to remove the top filler panel 47.

Figure 8A:
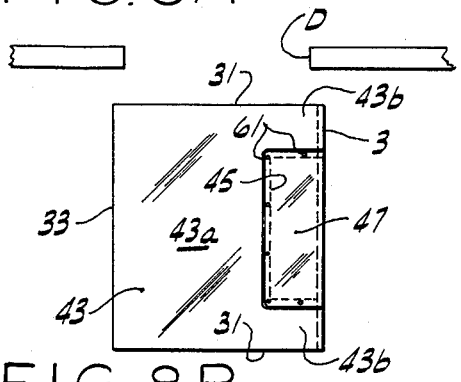
FIGS. 8A-F are a series of schematic drawings showing a vendor of this invention being maneuvered through a doorway narrower than the overall depth of the cabinet.
Figure 8D:
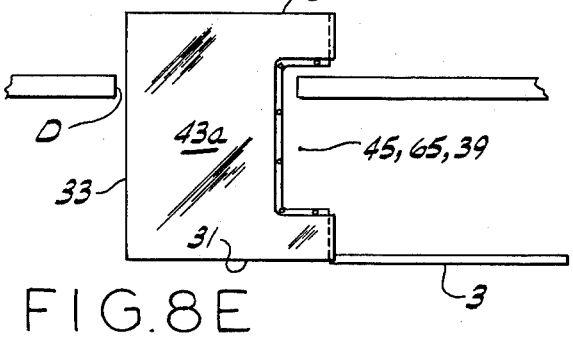
Figure 8E:
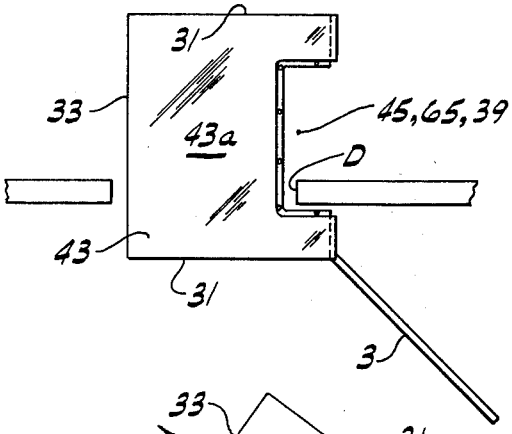
Figure 8B:
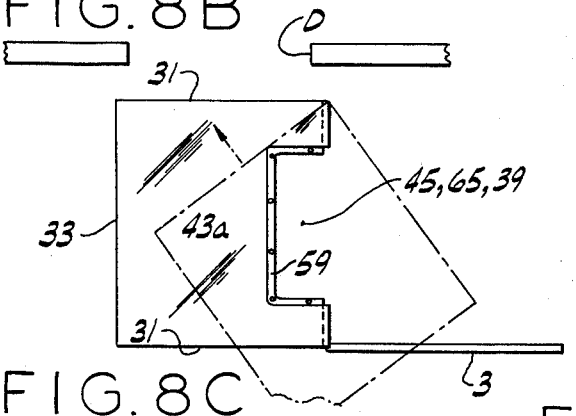
Figure 8C:
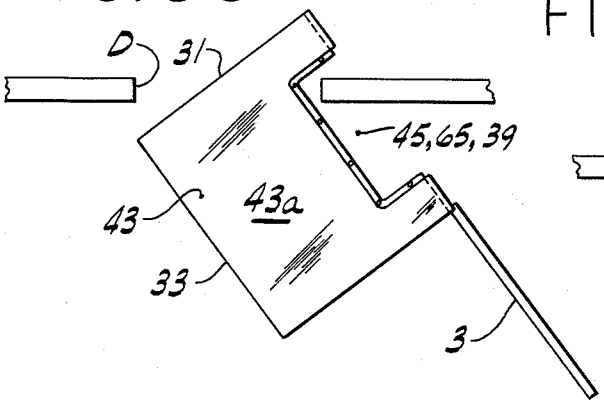
Figure 8F:
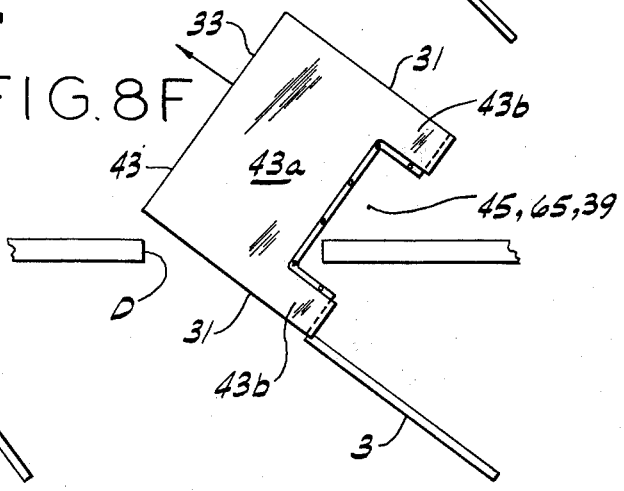

The partition 35 has a recess 65 extending back from the front of the cabinet a distance corresponding to the depth from front to rear of the recesses 39 and 45 in the bottom and top main panels. The fronts of the shelves will generally extend somewhat farther forward than the vertical plane of the rear edges of the recesses 39, 45 and 65. In such case, if the full depth of the recesses is needed for maneuvering the cabinet through a doorway, as will appear, the shelves may be slid entirely out of the cabinet and removed. Thus, with the door 3 open, and with the bottom and top filler panels 41 and 47 removed and the recesses 39, 45 and 65 open, the cabinet may be maneuvered through a doorway D which is narrower than the overall width or depth of the cabinet, but wider than the depth of the cabinet from the rear edges of recesses 39, 45 and 65 to the back of the cabinet, in the manner such as illustrated in FIGS. 8C–8F. FIG. 8A illustrates the cabinet in a preliminary position on one side of the doorway prior to opening the door 3 and removing the filler panels 41 and 47, and FIG. 8B illustrates the cabinet in this same position with the door 3 opened and the filler panels removed. This enables the cabinet to be angled in the direction shown in phantom in FIG. 8B, and moved in this direction as indicated by the arrow in FIG. 8B partly through the doorway to work its right front corner through the doorway with one side (the right side as shown) of the doorway received in the recesses 39, 45 and 65 as shown in FIG. 8C. Then, the cabinet may be shifted as shown in FIG. 8D to a position in line with the doorway, and moved through the doorway as far as permitted by the recesses to the position shown in FIG. 8E. From the FIG. 8E position, the cabinet is angled as shown in FIG. 8F to work its left rear corner through the doorway, after which it may be moved in the direction indicated by the arrow in FIG. 8F to complete its passage through the doorway.

As illustrated in FIG. 4, the top filler panel 47 has a flange 67 extending from one side of the panel to the other set back from the front edge of the panel a distance generally corresponding to the thickness of the front door 3, this flange 67 extending downwardly from the panel into cabinet 1. The inner face of the front door 3 abuts flange 67 with the front margin of the filler extending to the outer face of front door 3 and overlying the top edge of the door when the door is closed. Side portions 43b of the main top panel 43 and cabinet sides 31 have similar flanges also designated 67 spaced inwardly of their respective front edges a distance generally corresponding to the thickness of front door 3 thereby providing a frame to receive the door in a closed position for a more pleasing appearance and added protection against forcible entry into the cabinet (see FIG. 2).

From the above, it will appear that by opening the door 3 and removing the bottom and top filler panels 41 and 47 to open up the spaces 39 and 45 (and removing the shelves 7 and 9, if necessary), the cabinet may be maneuvered through a doorway which is narrower than the overall width of depth of the cabinet, but wider than the depth of the cabinet from the back of the cabinet to the spaces 39, 45, 65. The filler panels cannot be readily removed except by authorized personnel having a key to unlock the front door, due to the securing means therefor being accessible only from the inside of the cabinet when the front door is open.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A vendor comprising a cabinet having a bottom, top, sides, back and a front door, the bottom comprising a main bottom panel formed to provide a space between the front of the cabinet and the main bottom panel and a filler removably attached to the cabinet and filling said space, the top comprising a main top panel formed to provide a space between the front of the cabinet and the main top panel and a filler removably attached to the cabinet and filling the latter space, said fillers being removable to open said spaces to enable the cabinet to be maneuvered, with the front door open, through a doorway which is narrower than the overall width or depth of the cabinet but wider than the depth of the cabinet from the back of the cabinet to said spaces.

2. A vendor as set forth in claim 1 wherein each of said fillers comprises a panel removably secured to its respective main panel by means which is accessible for the removal of the filler only from the inside of the cabinet when the front door is open.

3. A vendor as set forth in claim 1 wherein each of the main bottom and top panels has a recess at the front providing said space between the front of the cabinet and the panel, portions of the panel on opposite sides of the recess extending to the front of the cabinet.

4. A vendor as set forth in claim 3 wherein each of the fillers comprises a filler panel seated against the respective main panel at the sides and rear of the respective recess.

5. A vendor as set forth in claim 4 wherein each filler panel is removably secured to its respective main panel around the respective recess by means which is accessible for the removal of the filler only from the inside of the cabinet when the front door is open.

6. A vendor as set forth in claim 5 wherein each filler panel has a front flange engageable by the front door.

7. A vendor as set forth in claim 6 wherein the flange of the top filler panel is set back from the front edge of the top filler panel to provide a recess for receiving the top of the front door.

8. A vendor as set forth in claim 1 having a plurality of shelves in the cabinet one above another, each shelf being slidable out of the cabinet through the front of the cabinet, and having its forward end spaced rearward from the front door, thereby providing space between the front of the shelves and the front of the cabinet for the maneuvering of the cabinet through a doorway.

9. A vendor as set forth in claim 8 having a horizontal partition below the lowermost shelf, said partition being formed to provide a recess between the front of the cabinet and said partition to allow for the maneuvering of the cabinet through a doorway.

10. A vendor as set forth in claim 9 wherein the shelves extend forward beyond the rearward edges of the recesses and may be removed from the cabinet to provide the full depth of the recesses for maneuvering of the cabinet through a doorway.

* * * * *